United States Patent [19]

Schippers

[11] Patent Number: 4,743,186

[45] Date of Patent: May 10, 1988

[54] MELT SPINNING APPARATUS

[75] Inventor: Heinz Schippers, Remscheid, Fed. Rep. of Germany

[73] Assignee: Barmag AG, Remscheid, Fed. Rep. of Germany

[21] Appl. No.: 902,306

[22] Filed: Aug. 29, 1986

[30] Foreign Application Priority Data

Aug. 31, 1985 [DE] Fed. Rep. of Germany ..... 3531265
Sep. 19, 1985 [DE] Fed. Rep. of Germany ..... 3533381

[51] Int. Cl.[4] ..... B29D 31/00

[52] U.S. Cl. ..... 425/72.2; 264/237; 264/174

[58] Field of Search ..... 425/66, 72 R, 72 S; 264/237, 177 F

[56] References Cited

U.S. PATENT DOCUMENTS 4,631,018 12/1986 Valteris ..... 425/72 S

FOREIGN PATENT DOCUMENTS 51808 4/1980 Japan ..... 264/211.4
1088240 10/1967 United Kingdom ..... 425/72 S
2135629 9/1984 United Kingdom .

*Primary Examiner*—Bernard Nozick
*Attorney, Agent, or Firm*—Bell, Seltzer, Park & Gibson

[57] ABSTRACT

A melt spinning apparatus is disclosed which includes a spinning nozzle for extruding a plurality of filaments from a polymeric melt, and which includes a spinning tube positioned below the nozzle for receiving the filaments. The upper end portion of the spinning tube is perforated, and an air blowing chamber surrounds the perforated upper end portion of the tube for supplying cooling air, and so that the air passes through the perforations to cool the filaments. The interior of the perforated end portion of the spinning tube also mounts a plurality of annular rings which are disposed in an axially spaced apart relation along the length of the end portion, for guiding the cooling air so as to flow in a generally radial direction into contact with the extruded filaments.

3 Claims, 2 Drawing Sheets

MELT SPINNING APPARATUS

BACKGROUND OF THE INVENTION

The present invention relates to a melt spinning apparatus for extruding and spinning synthetic polymeric filaments and the like.

Melt spinning apparatus are known wherein the polymeric melt is extruded downwardly through a spinning nozzle to form a plurality of advancing filaments, and wherein a spinning tube is positioned below the nozzle for receiving the filaments. Also, it is conventional to perforate the upper end portion of the spinning tube, and to surround the perforated upper end portion with an air blowing chamber, such that cooling air may be delivered through the perforations and into the interior of the tube, so as to cool the advancing filaments. A spinning apparatus of this type is further disclosed in German OS No. 34 06 347, and corresponding published British application No. 2,135,629A.

While the above described prior spinning apparatus have proven to be generally successful in operation, it has been found that in certain instances the cooling air supplied through the perforated upper end portion of the spinning tube to the newly spun group of filaments has not been as effective in uniformly cooling the filaments as desired. It is accordingly an object of the present invention to provide a melt spinning apparatus of the described type and which provides an improved and more uniform cooling of the advancing filaments as they move through the spinning tube.

SUMMARY OF THE INVENTION

This and other objects and advantages of the present invention are achieved in the embodiments illustrated herein by the provision of a melt spinning apparatus which comprises melt spinning means including a spin nozzle for continuously extruding a plurality of synthetic filaments downwardly through the nozzle, and a spinning tube disposed below the spin nozzle and so that the extruded filaments pass through the tube. The spinning tube includes an end portion adjacent the spinning nozzle which has a plurality of perforations extending radially through the wall of the tube, and a blowing chamber surrounds the perforated end portion of the spinning tube for supplying a cooling medium such as air thereto, and such that the cooling medium passes through the perforations and into the interior of the tube so as to cool the extruded filaments. Further, guide means is positioned within the perforated end portion of the spinning tube for guiding at least a substantial portion of the cooling medium which enters through the perforations, and so that the cooling medium flows in a generally radial direction into contact with the extruded filaments.

In a preferred embodiment, the guide means of the present invention includes at least one and preferably several annular rings disposed coaxially in the spinning tube and in an axially spaced apart relation along the length of the perforated end portion. Also, the rings define inner openings which are only slightly greater than the cross sectional outline of the extruded filaments passing therethrough.

In a melt spinning apparatus of the described type, it is common for the filaments to be guided in a converging i.e., conical configuration as they advance through the spinning tube, and in such event, the annular rings may be provided with inner openings which decrease in diameter as the distance from the spinning nozzle increases, and so that each of the diameters is only slightly greater than the cross sectional outline of the extruded filaments passing therethrough. The rings may be in the form of flat plates which are fixed to the interior of the spinning tube and in a perpendicular relationship to the axis thereof. In addition, the inner openings of the rings may each have an inner edge surface which is inclined to define a portion of a cone which converges in the general direction of the advancing yarn. Alternatively, the inner edge surfaces of the openings of the rings may be arcuately curved to define a portion of a torus, and so as to prevent damage to the filaments which may inadvertently contact the same. In this latter embodiment, the boundary of the ring opening preferably should not project beyond the flat surfaces of the ring, but they should be flush with the same so as to avoid interference with the guided flow of the cooling air.

It has been found that the air flow can be improved by a single annular ring as described above. However, it is preferable to provide no less than two rings, and preferably several rings, in the manner described above. It is also desirable that the diameter of each of the ring openings be greater than the diameter of the imaginary circular outline which encloses the adjacent portion of the group of filaments by only a small amount which just prevents contact with the outer filaments. Thus each ring opening is adapted to the circular cross sectional outline of the filaments at the location of such ring, which as noted above typically converges conically as it advances through the spinning tube.

BRIEF DESCRIPTION OF THE DRAWINGS

Some of the objects and advantages of the present invention having been stated, others will appear as the description proceeds when taken in conjunction with the accompanying drawings, in which.

DETAILED DESCRIPTION OF THE PREFERRED EMBODIMENTS

Figure 1:
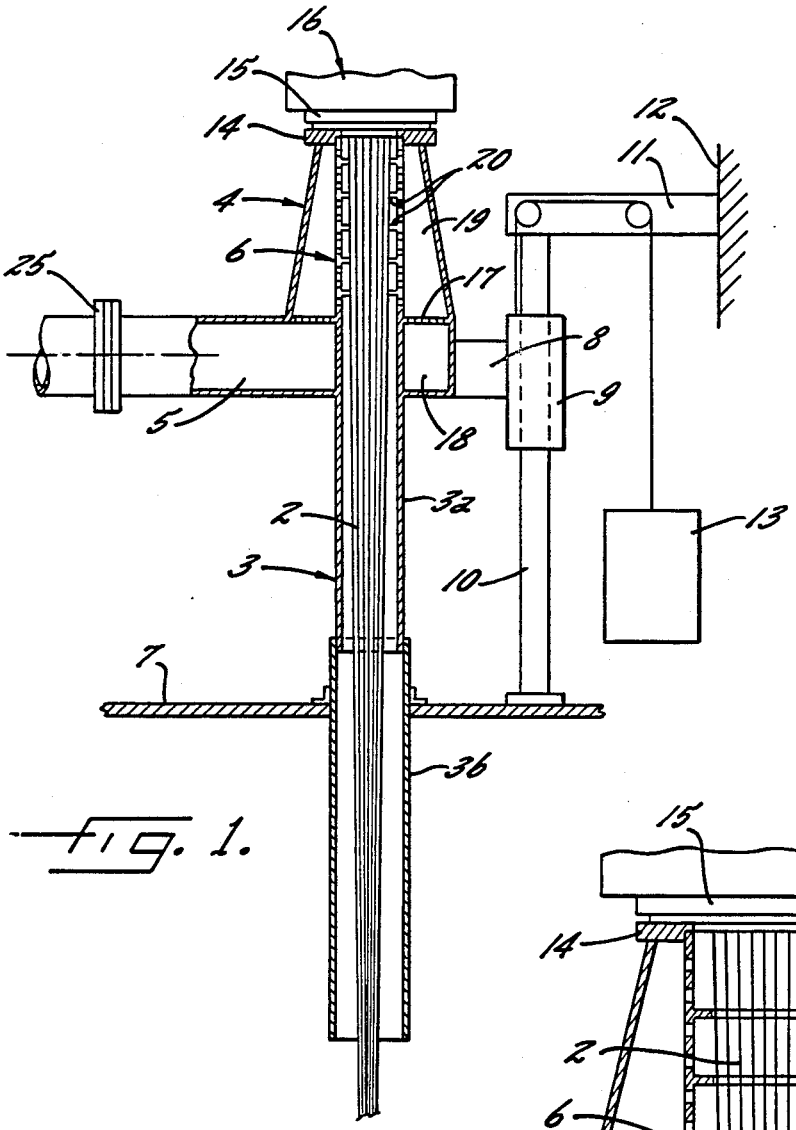
FIG. 1 is a schematic cross sectional side elevation view of a melt spinning apparatus which embodies the features of the present invention.

Referring more particularly to the drawings, a melt spinning apparatus is schematically illustrated in FIG. 1 which includes a nozzle assembly 16, which includes a lower tubular casing 15 having a cylindrical bore and with the casing 15 enclosing and supporting a spinning nozzle (not shown). The spinning nozzle is in the form of a plate having a plurality of small openings therethrough, and such that the polymeric melt supplied to the assembly 16 is extruded through the openings to produce a plurality of filaments 2, which are typically in a circular pattern when viewed in horizontal cross section. A nozzle assembly of the described type is conventional, and further details regarding its construction may be obtained from copending and commonly owned U.S. patent applications, Ser. Nos. 593,034, now U.S.

Pat. No. 4,645,444, and 767,480 now U.S. Pat. No. 4,681,522.

A spinning tube 3 is positioned below and in coaxial alignment with the tubular casing 15 and the spinning nozzle, and the tube 3 comprises two telescopically interconnected tube sections 3*a* and 3*b*. The upper portion 6 of the upper section 3*a* includes perforations 24 which extend radially through the peripheral wall of the tube, and the remaining portion of the section 3*a* is nonperforated.

The upper portion 6 of the spinning tube section 3*a* mounts an annular flange 14 which engages the tubular casing 15, and the upper portion 6 is also surrounded by a blowing chamber 4, which has an air supply connection at 5. The blowing chamber 4 is itself divided into a lower intake portion 18 and an upper outlet portion or distribution box 19, which is separated from the intake portion 18 by a wall 17 which consists of a perforated grid-like insert. The perforations 24 of the upper portion 6 of the spinning tube 3 extend only over the length of the distribution box 19. Peforations may also be contained in other portions of the spinning tube, but preferably they are not included in the portion which extends through the lower intake portion 18 of the blowing chamber.

The lower tube section 3*b* is fixedly mounted to a support 7, and as will be apparent from FIG. 1, the upper section 3*a* of the spinning tube can be lowered into the section 3*b* for the purpose of changing nozzles and the like. To this end, the blowing chamber 4 includes a releasable coupling at 25, and it is connected, via a carrier arm 8, with a slide 9 which is guided along a vertical column 10. The column 10 is anchored to the support 7 and the wall 12 of the building by the horizontal support 11 in the illustrated embodiment, and a counterweight 13 holds the upper section 3*a* of the spinning shaft, together with the blowing chamber 4, in the raised position. A suitable force is therefore required to lower these components.

Figure 2:
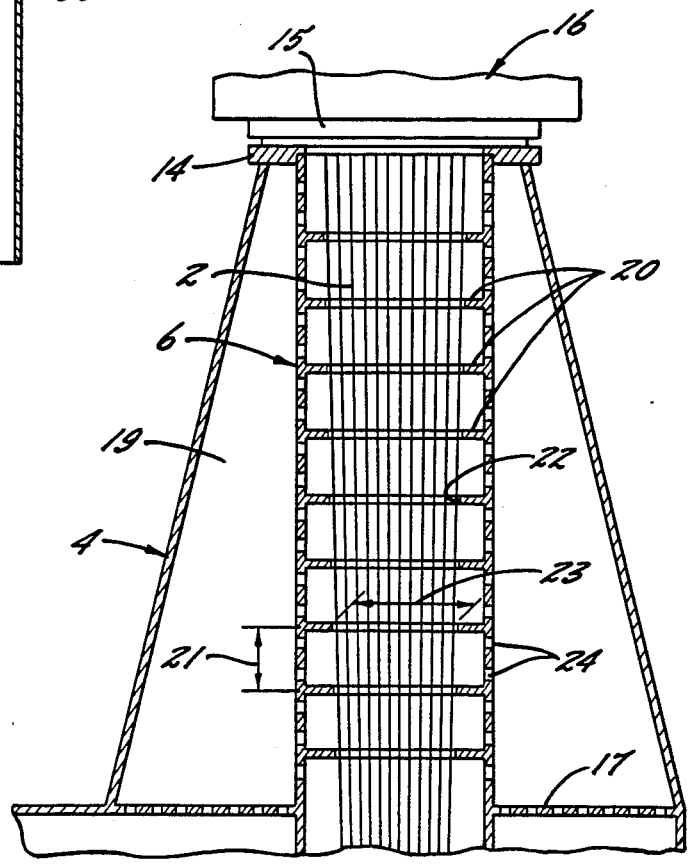
FIG. 2 is an enlarged fragmentary cross sectional view of the upper end portion of the spinning tube and surrounding blowing chamber.

As best seen in FIG. 2, guide means is positioned within the perforated end portion 6 of the spinning tube for guiding cooling air which enters through the perforations 24, so that the air flows in a generally radial direction into contact with the extruded filaments 2. In the illustrated embodiment, the guide means comprises nine flat annular rings 20, which are disposed perpendicularly to the axis of the tube 3, and spaced an equal axial distance 21 from each other. However, it will be understood that a different number of rings may be employed. In some cases, a single ring 20 will be sufficient to produce desirable results, although it has been found that at least two rings 20 should be provided as a rule. The particular number depends in each instance on the local conditions, such as the number of filaments, the denier of the individual filaments, the material of the filaments, spinning velocity, etc. Where several rings are employed, the axial distance may be equal, although in some cases the axial distance may increase for example in the direction of the advancing yarn.

Figure 3:
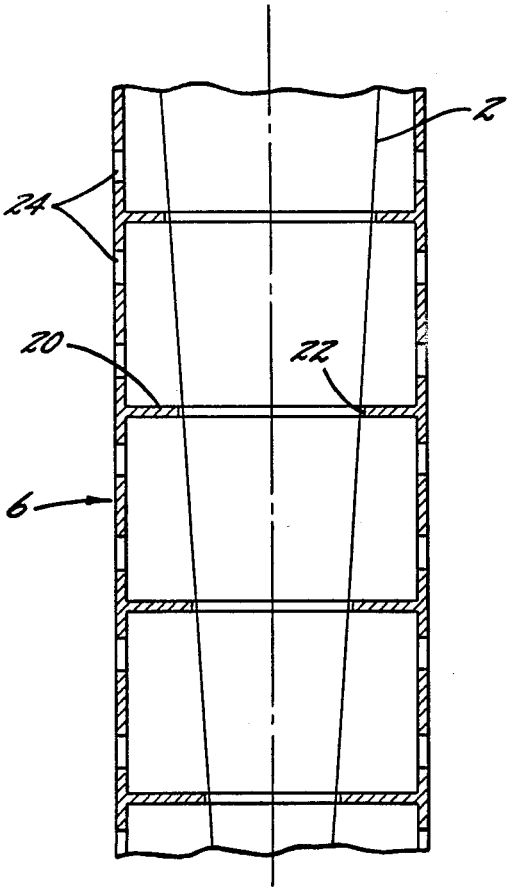
FIG. 3 is a fragmentary cross-sectional view of the upper perforated end portion of the spinning tube.

As best seen in FIGS. 2, and 3, each of the rings 20 defines an inner circular opening 22 which closely conforms to the cross sectional circular outline of the adjacent portion of the extruded filaments passing through the tube 3. Since the filaments converge as they move downwardly through the tube 3 toward the point of combination, the diameters 23 of the openings 22 decrease as the distance from the spinning nozzle increases. Also, the diameters 23 of the individual ring openings 22 should be adapted as closely as possible to the cross sectional outline of the adjacent portion of the group of filaments, and the diameters should be greater than the outline of the filaments only by an amount which assures the prevention of contact.

Figure 4:
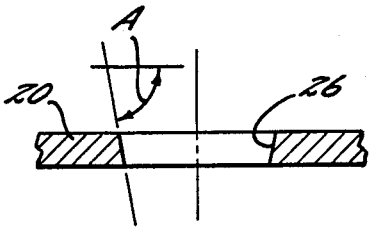
FIG. 4 is an enlarged cross sectional view of one of the annular rings in the spinning tube.
Figure 5:
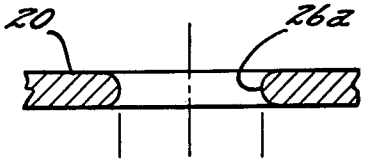
FIG. 5 is a view similar to FIG. 4 but illustrating a different embodiment of the annular ring.

FIG. 4 illustrates one preferred construction for the inner edge surface of the openings 22 of the rings. As illustrated, the inner edge surface 26 is inclined to define a portion of a cone, and with the angle A of the cone generally conforming to the direction of inclination of the conical arrangement of the filaments. FIG. 5 illustrates an alternative embodiment, wherein the inner edge surface 26*a* is arcuately curved to define a portion of a torus. Also, the curvature of the arcuate edge surface will be seen to merge with the flat surfaces of the ring 20, so as to avoid interference with the smooth flow of the cooling air along the surfaces of the ring.

In the drawings and specification, there has been set forth a preferred embodiment of the invention, and although specific terms are employed, they are used in a generic and descriptive sense only and not for purposes of limitation.

That which I claim is:

1. A melt spinning apparatus for extruding and spinning a synthetic material to form a plurality of filaments, and comprising melt spinning means including a spinning nozzle for continuously extruding a plurality of synthetic filaments downwardly through said spinning nozzle, and with said plurality of filaments having a generally circular cross sectional outline, a spinning tube disposed below said spinning nozzle and so that the extruded filaments pass through said tube, with said spinning tube including a tubular wall and an end portion adjacent said spinning nozzle which has a plurality of perforations extending radially through said wall, and means for guiding the advancing filaments in a converging generally conical arrangement as they pass through said spinning tube, blowing chamber means surrounding said perforated end portion of said spinning tube for supplying a cooling medium thereto and such that the cooling medium passes through said perforations and into the interior of said tube so as to cool the extruded filaments, and guide means positioned within said perforated end portion of said spinning tube for guiding at least a substantial portion of the cooling medium which enters through said perforations so as to flow in a generally radial direction into contact with the extruded filaments, said guide means comprising a plurality of flat annular rings which are fixed to the interior of said spinning tube and in a perpendicular relationship to the axis thereof, with said annular rings being disposed coaxially in said spinning tube and in an axially spaced apart relation along the length of said end portion, and with each of said rings defining a circular inner opening which closely conforms to the circular cross sectional outline of the extruded filaments passing therethrough, and with the diameters of said openings decreasing as the distance from said spinning nozzle increases and so that each of the diameters is only slightly greater than the cross sectional outline of the adjacent portion of the extruded filaments.

2. The melt spinning apparatus as defined in claim 1 wherein each of said inner openings of said annular rings has an inner edge surface which is inclined to define a portion of a cone and which is inclined at an angle which generally conforms to the direction of inclination of the conical arrangement of said filaments.

3. The melt spinning apparatus as defined in claim 1 wherein each of said inner openings of said annular rings has an inner edge surface which is arcuately curved to define a portion of a torus.

* * * * *